US008300863B2

(12) United States Patent
Knudsen et al.

(10) Patent No.: US 8,300,863 B2
(45) Date of Patent: Oct. 30, 2012

(54) HEARING DEVICE AND METHOD FOR A WIRELESS RECEIVING AND/OR SENDING OF DATA

(75) Inventors: Ove Knudsen, Smørum (DK); Poul Henriksen, Smørum (DK); Thorvaldur Oli Bodvarsson, Smørum (DK)

(73) Assignee: Oticon A/S, Smorum (DK)

( * ) Notice: Subject to any disclaimer, the term of this patent is extended or adjusted under 35 U.S.C. 154(b) by 554 days.

(21) Appl. No.: 12/342,241

(22) Filed: Dec. 23, 2008

(65) Prior Publication Data

US 2009/0169038 A1 Jul. 2, 2009

(30) Foreign Application Priority Data

Dec. 27, 2007 (EP) ..... 07124109

(51) Int. Cl.
*H04R 25/00* (2006.01)

(52) U.S. Cl. ..... 381/315; 381/6

(58) Field of Classification Search ..... 381/6, 315
See application file for complete search history.

(56) References Cited

U.S. PATENT DOCUMENTS

| | | | | |
|---|---|---|---|---|
| 6,021,207 | A | 2/2000 | Puthuff et al. | |
| 2005/0245289 | A1 | 11/2005 | Yoshino | |
| 2006/0071869 | A1* | 4/2006 | Yoshino et al. | 343/718 |
| 2007/0105438 | A1 | 5/2007 | Yoshino | |
| 2007/0171134 | A1 | 7/2007 | Yoshino et al. | |
| 2007/0230727 | A1* | 10/2007 | Sanguino et al. | 381/315 |
| 2009/0069060 | A1* | 3/2009 | Kim | 455/575.6 |

FOREIGN PATENT DOCUMENTS

| | | | |
|---|---|---|---|
| DE | 36 25 891 | A1 | 2/1988 |
| EP | 1 589 609 | A2 | 10/2005 |
| WO | WO-98/44762 | A1 | 10/1998 |
| WO | WO-2006/055884 | A2 | 5/2006 |

OTHER PUBLICATIONS

"Easy Listener" user guide, Phonic Ear Inc., pp. 1-12, (2002).

* cited by examiner

*Primary Examiner* — Jerome Jackson, Jr.
*Assistant Examiner* — Dale E Page
(74) *Attorney, Agent, or Firm* — Birch, Stewart, Kolasch & Birch, LLP

(57) ABSTRACT

The present invention is related in particular to means for a wireless communication to and from a hearing device (10) comprising a first portion (12) adapted for being arranged at a user and for providing a signal, an output transducer (18) for converting said signal to an acoustic output and a second portion (14) adapted for being arranged in an ear canal of said user and for providing said acoustic output to said user and further related to a method for a wireless receiving and/or sending of data in a hearing device (10). In order to provide such a hearing device (10) with sufficient characteristics regarding the ability to send and/or receive data in a wireless manner using desired frequencies without a need for additional external antenna solutions or for a size not meeting the current requirements of smallness for hearing devices a hearing device (10) it is proposed, further comprising a coupling element (16) coupling said first portion (12) and said second portion (14), an antenna, and a wireless interface (22) for receiving and/or sending data by means of said antenna, wherein said coupling element (16) comprises an electrically conducting element (24) coupled to said wireless interface (22), wherein said electrically conducting element (24) is at least a part of said antenna. A corresponding method and use of a hearing device is also proposed.

24 Claims, 3 Drawing Sheets

HEARING DEVICE AND METHOD FOR A WIRELESS RECEIVING AND/OR SENDING OF DATA

TECHNICAL FIELD

The present invention is related to a hearing device comprising a first portion adapted for being arranged at a user and for providing a signal, an output transducer for converting said signal to an acoustic output and a second portion adapted for being arranged in an ear canal of said user and for providing said acoustic output to said user. The invention is in particular related to means for a wireless communication to and/or from such a hearing device. The invention is further related to a method of wirelessly receiving and/or sending of data in a hearing device and to the use of a hearing device.

BACKGROUND ART

Hearing aids for compensating a wearer's hearing loss are well known. The present invention is particularly related to such kinds of hearing devices. However, the present invention may also be implemented in other types of listening devices, hearing instruments or hearing devices which comprise a connecting element between two physical parts of the device, e.g. a head set, a head phone, ear protection plugs, etc. In the following the terms "hearing device" or "hearing instrument" refer to devices in general which are related to providing an acoustic signal to a user's ear.

Hearing instruments, in particular hearing aids, are very dense applications and when integrating wireless applications, it may sometimes be difficult to find sufficient space for required or desired antenna components.

It is widely agreed that an integration of wireless systems into hearing instruments requires integration of antenna structures as well, if bulky external antenna solutions are to be avoided. The efficiency of the antenna and the wireless system is important, as low battery consumption is commonly a design parameter. Various configurations of hearing aids as examples of hearing devices are known, such as in-the-ear (ITE), completely-in-canal (CIC), behind-the-ear (BTE), or receiver-in-the-ear (RITE) hearing aids (the latter sometimes termed 'receiver in the canal').

The efficiency and bandwidth of antennas for electro-magnetic fields depend strongly on the size relative to a wavelength of the signal or field. However, common hearing instruments are typically much smaller than the wavelength in the appropriate frequency bands, which has a disadvantageous effect on the efficiency and bandwidth of the antennas build into the common hearing devices.

DISCLOSURE OF INVENTION

It is an object of the present invention to provide a hearing device and a method as mentioned above with sufficient characteristics regarding the ability to send and/or receive data in a wireless manner using desired frequencies (e.g. of the order of 1 GHz) without a need for additional external antenna solutions or for a size not meeting the current requirements of smallness for hearing devices (e.g. of the order of 0.01 m).

It is an additional object of the present invention that the above object is achieved with only few modifications to known designs for hearing devices and therefore that the improved hearing device may be based to a large extent on known and well-tested hearing devices without a need for a complex re-design.

In order to achieve the above objects, the present invention provides a hearing device comprising a first portion adapted for being arranged at a user and for providing a signal, an output transducer for converting said signal to an acoustic output, a second portion adapted for being arranged in an ear canal of said user and for providing said acoustic output to said user, a coupling element coupling said first portion and said second portion, an antenna, and a wireless interface for receiving and/or sending data by means of said antenna, wherein said coupling element comprises an electrically conducting element coupled to said wireless interface, wherein said electrically conducting element is at least a part of said antenna.

Further, the present invention provides a method for a wireless receiving and/or sending of data in a hearing device comprising a coupling element coupling a first portion and a second portion of said hearing device, the method comprising the steps of providing an electrically conducting element in said coupling element, arranging said first portion at a user of said hearing device, arranging said second portion in an ear canal of said user, and receiving and/or sending data by means of said electrically conducting element.

In a further aspect, the present invention provides use of a hearing device as defined above, in the description below and in the claims. In an embodiment, use of a hearing aid according to the invention (including the antenna and wireless interface provided by the hearing device) to wirelessly communicate with another communications device is provided. In an embodiment, such other communications device is another hearing device, e.g. the other hearing device of a binaural hearing aid system. In an embodiment, such other communications is an audio gateway, e.g. an audio selection device (cf. e.g. EP 1 460 769 or WO 2006/117365 A1) for wirelessly transmitting an audio signal to the hearing device, the audio signal being selected among a multitude of audio signals, possibly including that from a telephone handset, e.g. a mobile telephone. In an embodiment, the communication between the hearing device and the other communications device is governed by a specific protocol that is adapted to low power applications.

In an embodiment, the first portion of the hearing device comprises a transceiver for implementing the wireless interface and being electrically connected to the antenna. In an embodiment, the wireless interface is adapted for transmission and/or reception of audio and/or control data and/or programming data to/from a remote control unit for remotely controlling the settings of the hearing device (e.g. volume, program, etc.), a programming unit for changing the basic settings of the hearing device (e.g. filter coefficients, gain characteristics, etc.), an audio gateway, a wireless microphone, a mobile telephone, an entertainment device (e.g. a music player, a TV or the like). The data transmitted or received via the wireless interface are typically modulated e.g. on an analogue carrier (e.g. AM or FM) or according to a digital modulation scheme (e.g. frequency shift keying, e.g. according to the Bluetooth standard). Hence, the wireless interface typically comprises a modulator/demodulator adapted for the type of modulation used.

As mentioned above, the present invention relates in particular to hearing instruments of the BTE type and the RITE type, typically comprising a "behind the ear"—part (typically comprising a microphone and a signal processor and one or more—e.g. wireless—communications interfaces) and an "in the ear"-part connected by a connecting (or coupling) element (e.g. a wire or tube). In a RITE-type hearing instrument (comprising a receiver), the connecting element comprises electrical conductors for transferring a processed signal from the "behind the ear"-part of the hearing device to the receiver. In a hearing instrument where the receiver is located in the 'behind the ear' part, the connecting element (e.g. a tube) works as a guide of the acoustical signal from the receiver to the ear canal (e.g. via an ear mould). In that case an electrical conductor connected to a transceiver for the antenna is included in connecting element.

Known hearing instruments with receivers in the ear have conducting wires running at or around the ear to connect the receiver in the ear canal with the other part(s) of the hearing instrument. The present invention is based on the insight that these wires may be used as antenna for a built-in radio transceiver. The invention utilizes the wires, which are already there, as well as the structure of the hearing instrument as radiating elements for the integrated radio transceiver. A similar technique is provided according to the present invention for utilization in BTE (behind the ear) type hearing instruments, wherein—for example—an electrical wire is integrated into the tube connecting the ear mould with the (remainder of the) hearing instrument.

One or more of the electrical conductors in the RITE cord (or in the interconnecting tube of standard BTE type instruments) may be used as or in an antenna for wireless applications in the hearing instrument. This saves space in the device and reduces cost. Further, as the size of the coupling element allows for a better adaptation to a wavelength of the electromagnetic signal used for transmitting the data, the efficiency and bandwidth of the antenna is improved in comparison to known antenna solutions inside the hearing device.

No additional mechanical processes are required to manufacture an external or additional antenna structure. Only a few extra standard passive components are needed to implement for example a diplexer to couple the RF signal on to the wire, i.e. to the electrically conducting element.

It was found that an improvement of efficiency that can be achieved by using the RITE wires compared to an internal loop antenna with an area of maximum 100 $mm^2$ is about 6 dB at 1 GHz, which is a significant improvement from the estimated best case efficiency for the internal loop antenna of −16 dB.

According to a preferred embodiment of the present invention said second portion includes said output transducer, wherein said coupling element is adapted for transmitting said signal to said output transducer. The output transducer (also termed as "receiver") is provided in the ear of the user at a distance to an input transducer or microphone of the hearing aid, which reduces the risk of acoustic feedback. Further, the transmission of the signal to the output transducer may be achieved by a coupling element of small size since only the (electrical) signal has to be transmitted to the output transducer. Therefore, the coupling element and the hearing device as a whole may be designed to an unobtrusive look. It has to be noted that the output transducer is not necessarily coupled or connected to the electrically conducting element provided in the coupling element. In an embodiment, a separate conductor, only connected to a transceiver is available in the coupling element (i.e. the electrical connection to the receiver has its own dedicated conductor(s)).

According to another embodiment said electrically conducting element is adapted for carrying said signal upon transmission to said output transducer. Here, the same elements or wires are used as part of the antenna and as a transmission means for the signal to be outputted at the same time, which results in a design which is easy and simple to implement.

In a further embodiment said coupling element comprises two balanced wires for transmitting said signal to said output transducer, wherein said electrically conducting element comprises said wires. The signal transmission wires are used as (at least a part) of the electrically conducting element acting as (at least a part) of the antenna to the wireless interface.

According to a yet further embodiment, said wireless interface is coupled to said wires via a high-pass filter, wherein said wireless interface is coupled to said high-pass filter via a balun and wherein said high-pass filter is coupled to said wires via respective capacitors, wherein said first portion includes a low-pass filter in the path of said signal. It was found that by such an implementation good results are achievable with very few modifications to a pre-existing hearing device design. In this context it is found to be sufficient that said balun comprises a transformer and that said high-pass filter comprises a capacitor and an inductance. A balun in general is a passive electronic device that converts between balanced and unbalanced electrical signals. The skilled person is well aware of a number of examples of baluns.

In another embodiment of the present invention said coupling element comprises two wires for transmitting said signal to said output transducer and a shield element for shielding said wires, wherein said electrically conducting element comprises said shield element. As an alternative or in addition to the above options, the shielding of the transmitting wires for the signal to the output transducer are usable as (at least a part of) an antenna.

According to a further embodiment wherein said wireless interface is coupled to said shield element via a high-pass filter, wherein said wireless interface is coupled to said high-pass filter via a balun, wherein said first portion includes a low-pass filter in the path of said signal. Again, it was found that by such an implementation good results are achievable with very few modifications to a pre-existing hearing device design. Further, it is found to be sufficient in this context as well that said balun comprises a transformer and that said high-pass filter comprises a capacitor and an inductance.

According to another preferred embodiment of the present invention, said first portion includes said output transducer and wherein said coupling element is provided for transmitting said acoustic output to said second portion. An example of such an arrangement is a BTE type hearing aid, which is among the types of hearing aids which are most commonly used. The acoustic output is generated at the first portion, for example by an output transducer integrated in a behind-the-ear portion of a hearing aid, wherein the acoustic output (signal) is transmitted or guided by means of the coupling element to the second portion, e.g. an ear mould, and provided to the user in the ear canal. According to a further embodiment of the present invention, said wireless interface is coupled to said electrically conducting element (forming part of the coupling element) via a balun. According to a yet further embodiment, said coupling element comprises a tube for transmitting said acoustic output to said second portion, in particular a flexible tube.

In another embodiment of the present invention, said wireless interface is adapted for receiving and/or sending data by means of radio frequency signals, in particular by means of electromagnetic radiation in the frequency range of 1 MHz to 1000 GHz, preferably of 1 MHz to 3 GHz, wherein the wireless interface is most preferably adapted for receiving and/or sending data according to a communications standard, in particular according to Bluetooth.

In an embodiment, the electrical conductor forming part of the coupling element and the antenna has the form of a longitudinal element, e.g. a wire. In an embodiment, said electrical conductor has a spatial extension less than 5 cm, such as less than 4 cm, such as less than 3 cm.

In an embodiment, the hearing device comprises a hearing instrument comprising an input transducer for converting an input sound to an electric input signal and an output transducer for converting an electric output signal to an output sound for being presented to a wearer of the hearing instrument, an electric forward path being defined between the input and output transducers and comprising a signal processing unit for providing a frequency dependent gain to the electric input signal according to a user's needs and for providing a processed output signal coupled to the output transducer, a wireless interface comprising an antenna and a transceiver for establishing a wireless link to another device. In an embodiment, the input transducer, the signal processing unit, the output transducer and the transceiver form part of a first portion of the hearing device (e.g. adapted to be located at or behind an ear of the user). In an embodiment, the input transducer, the signal processing unit and the transceiver form part of the first portion of the hearing device (e.g. adapted to be located at or behind an ear of the user) and the output transducer form part of a second portion of the hearing device adapted to be located at or in the ear canal of the user.

According to a further embodiment of the present invention, said first portion is adapted for being arranged behind an ear of said user. If the first portion of the hearing device is arrangeable behind an ear of a user, the hearing device may be used in an unobtrusive manner, wherein the first portion is hidden to some extent by the ear.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

In the following, exemplary embodiments of the present invention are further explained referring to the attached drawings, in which.

The figures are schematic and simplified for clarity, and they just show details which are essential to the understanding of the invention, while other details are left out. Throughout, the same reference numerals are used for identical or corresponding parts.

MODE(S) FOR CARRYING OUT THE INVENTION

Figure 1:
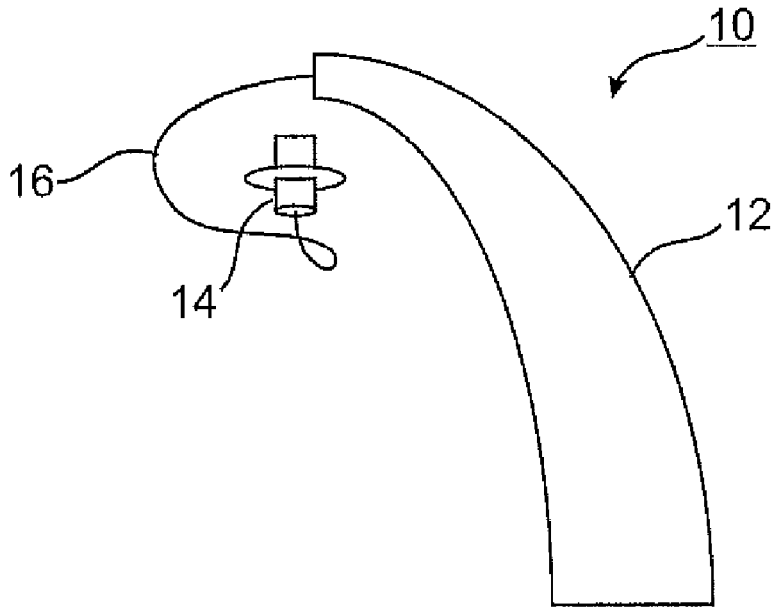
FIG. 1 shows a schematic view of a hearing device according to the invention.

FIG. 1 shows a schematic view of a hearing device according to the invention. The hearing device 10 comprises a first portion 12, a second portion 14 and a coupling element 16. The first portion 12 of the shown embodiment is designed to be arranged behind a user's ear, wherein the second portion 14 is designed to be placed inside an ear canal (not shown) of the user. The coupling element 16 couples the first portion 12 and the second portion 14 so that a signal generated by the first portion 12 is transmitted to the second portion 14. According to the shown implementation the second portion 14 includes a receiver (or output transducer). Accordingly, the shown hearing device 10 is of the RITE type. According to the present invention, an electrically conducting element (not shown in FIG. 1) of the coupling element 16 is used as an antenna for wireless communications to and from the hearing device 10.

Figure 2:
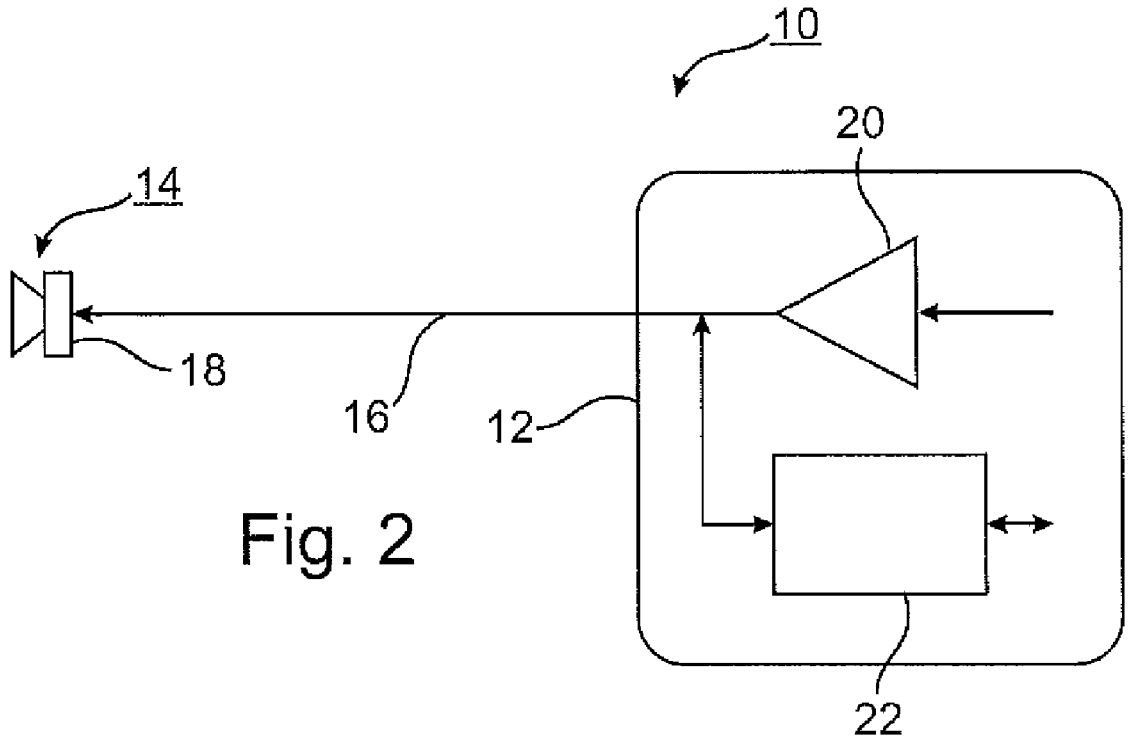
FIG. 2 shows a principal sketch of an electrical diagram illustrating the present invention.

FIG. 2 shows a principal sketch of an electrical diagram illustrating the present invention. The first portion 12 of the hearing device 10 comprises a signal processor 20 for generating and/or providing a signal and a wireless interface 22 for exchanging data with an external device (e.g. a communication device, such as a mobile telephone, not shown) via an antenna (not shown in FIG. 2). The hearing device 10 is further provided with an output transducer or receiver 18 as a part of the second portion 14. The first and second portion 12, 14, in particular the signal processor 20 and the receiver 18, are coupled by the coupling element 16. The signal processor 20 receives an input signal to be processed and outputs or generates a signal to the receiver 18 based on the input signal, wherein the receiver 18 converts the output signal of the signal processor 20 to an acoustic signal which is provided to the user of the hearing device 10.

In order to use the RITE wires as an antenna, matching circuitry (e.g. modulator/demodulator circuitry) for the RF signal and circuitry to separate the RF and the audio signals is preferably included in the hearing instrument. Two types of RITE cables with either two or three wires (one or two of the wires typically being used to connect to the receiver) are commonly used. In the first case, with only two balanced wires for the audio signal, both may be used as antenna. In the second case, where an additional shield wire is present, the latter is preferably used.

Most low power transceivers have a balanced RF I/O, and a balun is preferably provided to transform the balanced RF signal to single ended before it is applied to a diplexer and an antenna matching circuit. The diplexer preferably isolates the high frequency contents of the audio signal going to the receiver from the antenna and separates the audio and the RF signal sharing the RITE wires. It is particularly preferable that the diplexer and matching circuitry are highly integrated.

Figure 3A:
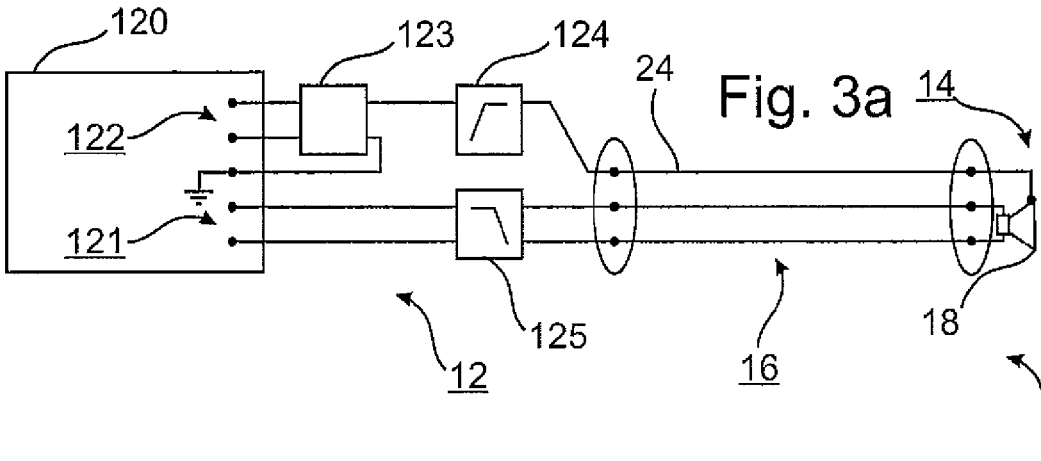
FIG. 3*a* shows a schematic block diagram of a hearing device according to a first embodiment of the present invention.
Figure 3B:
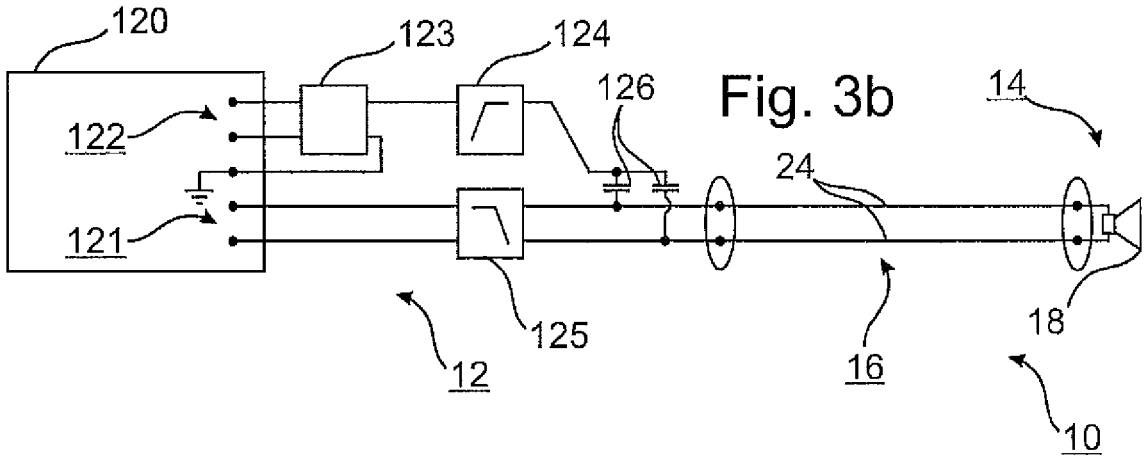
FIG. 3*b* shows a schematic block diagram of a hearing device according to a second embodiment of the present invention.

FIGS. 3*a* and 3*b* show block diagrams illustrating how the transceiver RF signal is isolated from the audio signal and connected to either the shield, in case of three RITE wires, or to both audio wires, if there are only two conductors present, according to a first and second exemplary embodiment of the present invention. A low pass filter is provided in series with the audio signal and a high pass filter is provided in series with the RF signal.

FIG. 3*a* shows a schematic block diagram of a hearing device according to a first embodiment of the present invention. The hearing device 10 comprises a first portion 12, a second portion 14 and a coupling element 16. The first portion 12 of the hearing device 10 includes a printed circuit board (PCB) 120 for realizing the primary features of the hearing device 10, e.g. the processing and generation of the signal to be provided to the user, audio signal connections 121, RF signal connections 122, a balun 123, a high-pass filter 124 and a low-pass filter 125. Further, the PCB 120 includes a wireless interface (not shown). The low-pass filter 125 is coupled to audio signal connections 121 of the PCB 120. The balun 123 is coupled to RF-signal connections 122 of the PCB 120. The balun 123 is further coupled to a ground connection and to the high-pass filter 124. The low-pass filter 125 and the high-pass filter 124 are coupled to wires of the coupling element 16, wherein the high-pass filter 124 is coupled to the electrically conducting element 24 forming the shield wire of the coupling element 16. The low-pass filter 125 is coupled to an output transducer 18 provided in the second portion 14. The audio signals are passed to the output transducer 18 and converted to an acoustic output, which in turn is supplied to the user. RF signals to be sent are converted by the balun 123 and passed through the high-pass filter 124, exciting the antenna including the electrically conducting element 24. In case the antenna or electrically conducting element 24 is excited by external RF signals arriving at said hearing device, these external RF signals are passed through the high-pass filter 124 and the balun 123 to enter the PCB 120 at the RF signal connections 122, where the external signals are received by the wireless interface (not shown).

FIG. 3*b* shows a schematic block diagram of a hearing device according to a second embodiment of the present invention. The second embodiment is similar to the first embodiment. The main difference is that there is no shield wire provided in the coupling element 16. Instead of being coupled to the shield wire as shown in FIG. 3*a*, the high-pass filter 124 is coupled to the wires transmitting the audio signal to the output transducer 18 via respective capacitors 126.

Figure 4:
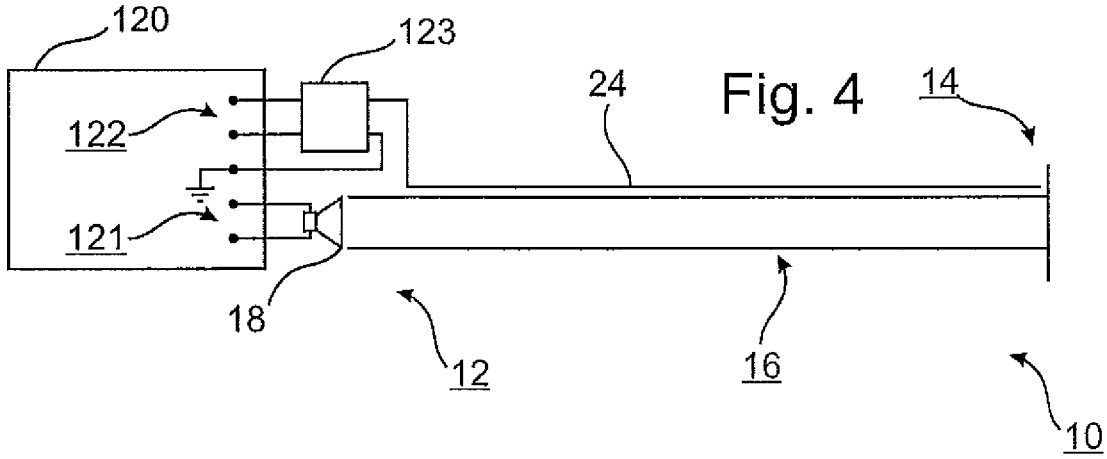
FIG. 4 shows a schematic block diagram of a hearing device according to a third embodiment of the present invention.

FIG. 4 shows a schematic block diagram of a hearing device according to a third embodiment of the present invention. Rather than providing the output transducer or receiver 18 in the second portion 14 and in the ear of the user as in the case of the first and second embodiment shown in FIGS. 3*a* and 3*b*, the output transducer 18 is provided in the first portion 12 of the hearing device 10 of the BTE type. The coupling element 16 comprises a tube for forwarding an acoustic signal outputted by the output transducer 18 to the ear of the user, via an ear-mould provided in the second portion 14 of the hearing device 10, which is to be arranged in the ear canal of the user (not shown). The balun 123 is coupled to an electrically conducting element 24 of the coupling element 16 acting as an antenna.

Figure 5A:
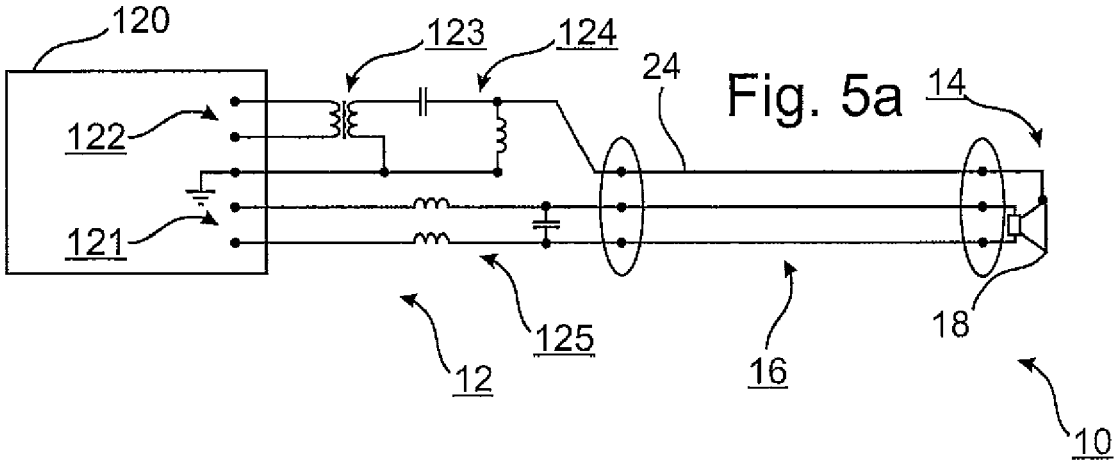
FIG. 5*a* shows a schematic block diagram of a particular implementation according to the first embodiment of the present invention shown in FIG. 3*a;*
Figure 5B:
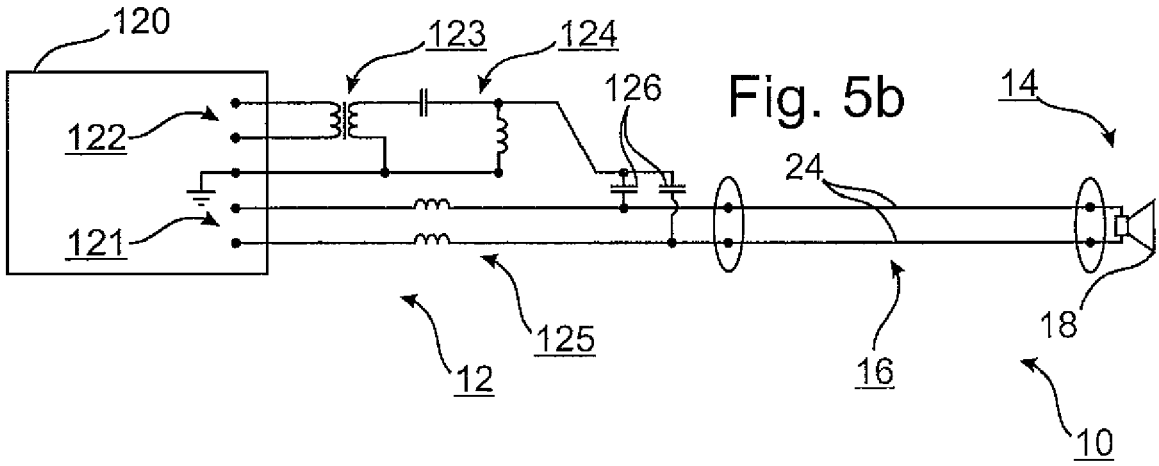
FIG. 5*b* shows a schematic block diagram of a particular implementation according to the second embodiment of the present invention shown in FIG. 3*b*.

FIGS. 5*a* and 5*b* show more detailed schematic block diagrams of a particular implementation according to the first and second embodiment of the present invention shown in FIG. 3*a* and FIG. 3*b*. The balun 123 is realized in form of a transformer 123, wherein the high-pass filter 124 comprises a capacitor and a inductance coupled in a suitable way. The low-pass filter 125 comprises inductances in series with the signal lines and a capacitor coupling the signal lines.

Figure 6:
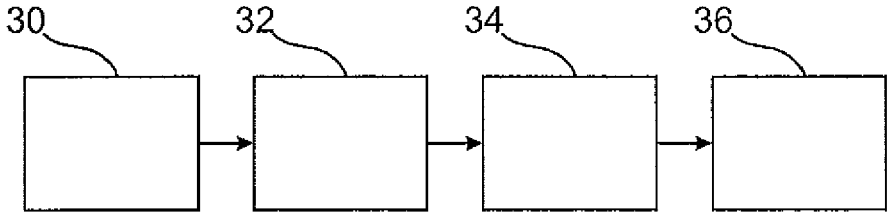
FIG. 6 shows a flow chart of a method according to the present invention.

FIG. 6 shows a flow chart of a method according to the present invention. The method for a wireless receiving and/or sending of data in a hearing device according to the present invention comprises the steps of providing (30) an electrically conducting element in said coupling element, arranging (32) said first portion at a user of said hearing device, arranging (34) said second portion in an ear canal of said user, and receiving (36) and/or sending data by means of said electrically conducting element. The order of the steps 30 to 34 may be changed.

According to a further preferred aspect of the present invention a hearing instrument comprises a first body adapted for being positioned behind an ear of a user and a second body adapted for being positioned in an ear canal of a user, and a connecting element mechanically and electrically connecting the first and second bodies, the first body being adapted to provide a processed electrical sound signal intended for being presented to a user via an output transducer and forwarded to the second body via the connecting element, the connecting element comprising at least one electrical conductor, wherein the electrical conductor is adapted to constitute an antenna for a wireless interface of the hearing instrument.

In a hearing instrument according to the above aspect the second body preferably comprises an output transducer for providing an acoustical signal to a user, wherein the hearing instrument is adapted to transmit the processed electrical sound signal to the output transducer via the at least one electrical conductor of the connecting element.

Additionally or alternatively to the implementation described in the previous paragraph the first body comprises an output transducer for providing an acoustical signal to a user, wherein the hearing instrument is adapted to transmit the acoustical signal to an ear canal of the user via the connecting element.

The hearing instrument as described in the preceding paragraphs preferably further comprises a transmitter for exciting the antenna, the transmitter being connectable to the antenna. It is also found to be advantageous if the antenna is adapted to transmit an RF-signal.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. A hearing device, comprising:

a first portion configured to be arranged at a user and to provide a signal to a second portion;

the second portion configured to be arranged in an ear canal of said user and to provide acoustic output to said user, the second portion including an output transducer for converting said signal into said acoustic output;

a coupling element coupling said first portion and said second portion and transmitting said signal to said output transducer, the coupling element including an electrically conducting element;

an antenna; and a wireless interface for receiving and/or sending data through said antenna, wherein said electrically conducting element is operatively coupled to said wireless interface and functions as at least a part of said antenna by wirelessly receiving or transmitting RF signals.

2. The hearing device according to claim 1, wherein said electrically conducting element is configured to carry said signal upon transmission to said output transducer.

3. The hearing device according to claim 1, wherein said coupling element comprises two balanced wires for transmitting said signal to said output transducer, wherein said electrically conducting element comprises said wires.

4. The hearing device according to claim 3, wherein said wireless interface is coupled to said wires via a high-pass filter, wherein said wireless interface is coupled to said high-pass filter via a balun and wherein said high-pass filter is coupled to said wires via respective capacitors, wherein said first portion includes a low-pass filter in the path of said signal.

5. The hearing device according to claim 4, wherein said balun comprises a transformer and wherein said high-pass filter comprises a capacitor and an inductance.

6. The hearing device according to claim 1, wherein said coupling element comprises two wires for transmitting said signal to said output transducer and a shield element for shielding said wires, wherein said electrically conducting element comprises said shield element.

7. The hearing device according to claim 6, wherein said wireless interface is coupled to said shield element via a high-pass filter, wherein said wireless interface is coupled to said high-pass filter via a balun, wherein said first portion includes a low-pass filter in the path of said signal.

8. The hearing device according to claim 7, wherein said balun comprises a transformer and wherein said high-pass filter comprises a capacitor and an inductance.

9. A hearing device, comprising:

a first portion configured to be arranged at a user and to provide acoustic output to a second portion, wherein said first portion includes an output transducer for converting a signal into the acoustic output;

the second portion configured to be arranged in an ear canal of said user and to provide said acoustic output to said ear canal;

a coupling element provided for transmitting said acoustic output to said second portion, the coupling element including an electrically conducting element, and a tube for acoustically transmitting said acoustic output to said second portion;

an antenna; and a wireless interface for receiving and/or sending data through said antenna, wherein said electrically conducting element is operatively coupled to said wireless interface and functions as at least a part of said antenna by wirelessly receiving or transmitting RF signals.

10. The hearing device according to claim 9, wherein said wireless interface is coupled to said electrically conducting element via a balun.

11. The hearing device according to claim 1, wherein said wireless interface is configured to receive and/or send data as radio frequency signals by electromagnetic radiation in the frequency range of 1 MHz to 1000 GHz, and the wireless interface is configured to receive and/or send data according to a communications standard.

12. The hearing device according to claim 1, wherein said first portion is adapted for being arranged behind an ear of said user.

13. A method of wirelessly receiving and/or sending of data in a hearing device comprising a coupling element coupling a first portion and a second portion of said hearing device, the method comprising the steps of:

providing an electrically conducting element in said coupling element;

arranging said first portion at a user of said hearing device;

arranging said second portion in an ear canal of said user;

operatively coupling said electrically conducting element to a wireless interface of the hearing device;

and wirelessly receiving and/or sending RF signals by said electrically conducting element.

14. The hearing device according to claim 6, wherein said shield element is a conductive wire operatively connected to the wireless interface.

15. The hearing device according to claim 9, wherein the tube is a flexible tube.

16. The hearing device according to claim 11, wherein the communications standard is Bluetooth.

17. The hearing device according to claim 11, wherein the frequency range is from 1 MHz to 3 GHz, inclusive.

18. The hearing device according to claim 1, wherein the first portion is a behind-the-ear portion configured to be located at or behind an ear of the user.

19. The hearing device according to claim 1, wherein said electrically conducting element included in the coupling element has a spatial extension less than 5 cm.

20. The hearing device according to claim 1, wherein the hearing device has a size on the order of 0.01 m.

21. The hearing device according to claim 9, wherein the first portion is a behind-the-ear portion configured to be located at or behind an ear of the user.

22. The hearing device according to claim 9, wherein said electrically conducting element included in the coupling element has a spatial extension less than 5 cm.

23. The hearing device according to claim 9, wherein the hearing device has a size on the order of 0.01 m.

24. The hearing device according to claim 9, wherein said second portion includes an ear mould.

* * * * *

US008300863C1

(12) EX PARTE REEXAMINATION CERTIFICATE (10345th)

United States Patent
Knudsen et al.

(10) Number: US 8,300,863 C1
(45) Certificate Issued: Oct. 20, 2014

(54) HEARING DEVICE AND METHOD FOR A WIRELESS RECEIVING AND/OR SENDING OF DATA

(75) Inventors: Ove Knudsen, Smørum (DK); Poul Henriksen, Smørum (DK); Thorvaldur Oli Bodvarsson, Smørum (DK)

(73) Assignee: Oticon A/S, Smorum (DK)

Reexamination Request:
No. 90/013,189, Mar. 25, 2014

Reexamination Certificate for:

| | |
|---|---|
| Patent No.: | **8,300,863** |
| Issued: | **Oct. 30, 2012** |
| Appl. No.: | **12/342,241** |
| Filed: | **Dec. 23, 2008** |

(30) Foreign Application Priority Data

Dec. 27, 2007 (EP) ..... 07124109

(51) Int. Cl.
*H04R 25/00* (2006.01)
*H04R 1/10* (2006.01)

(52) U.S. Cl.
CPC ..... *H04R 25/558* (2013.01); *H04R 2225/51* (2013.01); *H04R 1/1016* (2013.01); *H04R 2420/07* (2013.01)
USPC ..... 381/315; 381/6

(58) Field of Classification Search
None
See application file for complete search history.

(56) References Cited

To view the complete listing of prior art documents cited during the proceeding for Reexamination Control Number 90/013,189, please refer to the USPTO's public Patent Application Information Retrieval (PAIR) system under the Display References tab.

*Primary Examiner* — Albert J Gagliardi

(57) ABSTRACT

The present invention is related in particular to means for a wireless communication to and from a hearing device (10) comprising a first portion (12) adapted for being arranged at a user and for providing a signal, an output transducer (18) for converting said signal to an acoustic output and a second portion (14) adapted for being arranged in an ear canal of said user and for providing said acoustic output to said user and further related to a method for a wireless receiving and/or sending of data in a hearing device (10). In order to provide such a hearing device (10) with sufficient characteristics regarding the ability to send and/or receive data in a wireless manner using desired frequencies without a need for additional external antenna solutions or for a size not meeting the current requirements of smallness for hearing devices a hearing device (10) it is proposed, further comprising a coupling element (16) coupling said first portion (12) and said second portion (14), an antenna, and a wireless interface (22) for receiving and/or sending data by means of said antenna, wherein said coupling element (16) comprises an electrically conducting element (24) coupled to said wireless interface (22), wherein said electrically conducting element (24) is at least a part of said antenna. A corresponding method and use of a hearing device is also proposed.

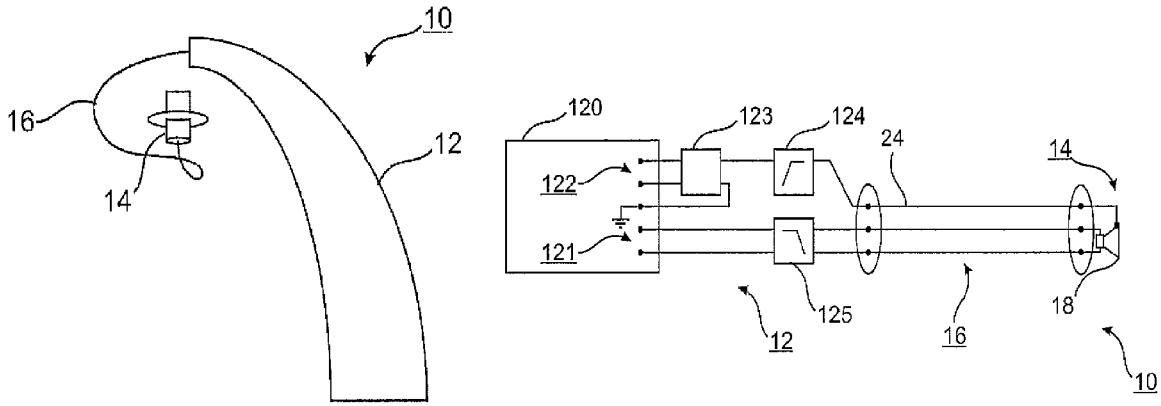

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3 and 13 are cancelled.

Claims 1, 4, 6 and 7 are determined to be patentable as amended.

Claims 5, 8, 11, 12, 14 and 16-20, dependent on an amended claim, are determined to be patentable.

New claim 25 is added and determined to be patentable.

Claims 9, 10, 15 and 21-24 were not reexamined.

1. A hearing device, comprising:

a first portion configured to be arranged at a user and to provide a signal to a second portion;

the second portion configured to be arranged in an ear canal of said user and to provide acoustic output to said user, the second portion including an output transducer for converting said signal into said acoustic output;

a coupling element coupling said first portion and said second portion and transmitting said signal to said output transducer, the coupling element including an electrically conducting element;

an antenna; and a wireless interface for receiving and/or sending data through said antenna, wherein said electrically conducting element [is] *comprises two balanced wires that transmit said signal to said output transducer, said two balanced wires being* operatively coupled to said wireless interface and [functions] *functioning* as at least a part of said antenna by wirelessly receiving or transmitting RF signals*, such that said two balanced wires function both as a link for transmitting said signal to said output transducer and as an antenna for wireless reception or transmission of RF signals*.

4. [The hearing device according to claim 3,] *A hearing device, comprising:*

*a first portion configured to be arranged at a user and to provide a signal to a second portion;*

*the second portion configured to be arranged in an ear canal of said user and to provide acoustic output to said user, the second portion including an output transducer for converting said signal into said acoustic output;*

*a coupling element coupling said first portion and said second portion and transmitting said signal to said output transducer, the coupling element including an electrically conducting element;*

*an antenna; and*

*a wireless interface for receiving and/or sending data through said antenna,*

*wherein said electrically conducting element is operatively coupled to said wireless interface and functions as at least a part of said antenna by wirelessly receiving or transmitting RF signals, and*

*wherein said coupling element comprises two balanced wires for transmitting said signal to said output transducer, wherein said electrically conducting element comprises said wires, and* wherein said wireless interface is coupled to said wires via a high-pass filter, wherein said wireless interface is coupled to said high-pass filter via a balun and wherein said high-pass filter is coupled to said wires via respective capacitors, wherein said first portion includes a low-pass filter in the path of said signal.

6. [The hearing device according to claim 1,] *A hearing device, comprising:*

*a first portion configured to be arranged at a user and to provide a signal to a second portion;*

*the second portion configured to be arranged in an ear canal of said user and to provide acoustic output to said user, the second portion including an output transducer for converting said signal into said acoustic output;*

*a coupling element coupling said first portion and said second portion and transmitting said signal to said output transducer, the coupling element including an electrically conducting element;*

*an antenna; and*

*a wireless interface for receiving and/or sending data through said antenna,*

*wherein said electrically conducting element is operatively coupled to said wireless interface and functions as at least a part of said antenna by wirelessly receiving or transmitting RF signals, and* wherein said coupling element comprises two wires for transmitting said signal to said output transducer and a shield element for shielding said wires, wherein said electrically conducting element comprises said shield element*, and*

*wherein said wireless interface is coupled to said shield element via a balun.*

7. The hearing device according to claim 6, wherein said wireless interface is coupled to said shield element via a high-pass filter, wherein said wireless interface is coupled to said high-pass filter via [a] *said* balun, wherein said first portion includes a low-pass filter in the path of said signal.

*25. The hearing device according to claim 1, wherein said wireless interface is coupled to said two balanced wires via a balun.*

* * * * *